US006189240B1

(12) United States Patent
Cowgill et al.

(10) Patent No.: US 6,189,240 B1
(45) Date of Patent: Feb. 20, 2001

(54) SHOE AND RELATED DISPLAY

(76) Inventors: Scott Cowgill, 1620 Oneida Pl., Oxnard, CA (US) 93030-8788; Jonothon T. McIntyre, 6997 Vista Del Rincon, Ventura, CA (US) 93001

( * ) Notice: Under 35 U.S.C. 154(b), the term of this patent shall be extended for 0 days.

(21) Appl. No.: 09/354,351

(22) Filed: Jul. 14, 1999

(51) Int. Cl.[7] ..... A43B 3/30

(52) U.S. Cl. ..... 36/112; 36/1; 446/26; 446/395

(58) Field of Search ..... 36/1, 112; D2/900, D2/899; 446/26, 329, 395, 72, 73; 206/457; 472/70

(56) References Cited

U.S. PATENT DOCUMENTS

| | | | |
|---|---|---|---|
| D. 49,946 | | 11/1916 | Blum . |
| D. 172,669 | | 1/1954 | Kleppen . |
| D. 189,082 | | 10/1960 | Goodman . |
| D. 327,361 | | 6/1992 | Rush et al. . |
| 1,909,645 | * | 5/1933 | Wiesner . |
| 2,823,490 | | 2/1958 | Griem . |
| 3,023,420 | * | 3/1962 | Tann . |
| 3,226,849 | * | 1/1966 | Rosen . |
| 4,200,197 | * | 4/1980 | Meyer et al. . |
| 4,736,847 | | 4/1988 | Wang . |
| 4,778,172 | * | 10/1988 | Bryan . |
| 5,058,293 | | 10/1991 | Villar . |
| 5,193,808 | * | 3/1993 | Takeshi . |
| 5,368,518 | * | 11/1994 | Hitchcock . |

* cited by examiner

*Primary Examiner*—Ted Kavanaugh
(74) *Attorney, Agent, or Firm*—Kelly Bauersfeld Lowry & Kelley, LLP

(57) ABSTRACT

A novelty shoe embodying a caricature of the head of an animal includes a sole and an upper which cooperate to form a foot-receiving compartment therebetween. The sole and the upper are configured such that a mouth of the caricature defines an entry for the foot-receiving compartment. A first portion of the upper is attached to the sole and forms a lower jaw of the caricature. A second portion of the upper extends from the toe and forms an upper jaw of the caricature. The upper second portion articulates relative to the entry of the foot-receiving compartment between open and closed positions and fasteners are provided for releasably securing the upper second portion in the closed position. The shoe may be displayed on a support in the form of a headless animal, wherein the shoe is positionable on the support such that the addition of the shoe creates the appearance of a completed animal.

32 Claims, 6 Drawing Sheets

SHOE AND RELATED DISPLAY

BACKGROUND OF THE INVENTION

The present invention relates to novelty footwear. More particularly, the present invention relates to shoes intended to appeal to children which are constructed and configured to impart the impression that the foot is being placed into the mouth of an animal's head.

Novelty footwear is known in the art. For example, U.S. Pat. No. Des. 49,946 provides an ornamental slipper having a head of a rabbit formed on a toe portion and a tail-like member on a heel portion of the slipper to give the appearance that the wearer's foot is a rabbit. Another example is U.S. Pat. No. Des. 189,082 which is a slipper in the form of an animal paw. Yet another example is U.S. Pat. No. Des. 327,361 wherein a child's bootie is formed in the shape of a dog, bear or rabbit head. Still another example is U.S. Pat. No. 5,085,294 which provides an article of footwear having an animated face with eyes which move in response to weight transfer while walking in the footwear in order to give the appearance of the registration of pain with each step.

Additionally, there is footwear of the tennis or athletic style which is intended to appeal to children and which can be used in a variety of settings. However, such footwear typically comprises a standard tennis or athletic style shoe having only minor modifications, usually directed to colors, prints, character decals and the like which are sewn or otherwise adhered to the shoe. Oftentimes, these minor modifications alone are not enough to appeal to the imagination or adventurous spirit of a child.

Practically all articles of footwear are displayed in various stores in the same manner. Specifically, shoes are typically arranged on inclined shelving to present the footwear to the potential buyer. The footwear are often placed according to size, resulting in unrelated footwear being placed next to one another. The shelving can be quite high, preventing a child from adequately viewing the footwear. Such existing displays are not appealing to consumers, and particularly not to children.

Therefore, what is needed is an article of footwear which is appealing to children while capable of being used in a variety of settings and environments. What is further needed is a display which integrates the footwear to appeal to the consumer, and particularly to children. The present invention fulfills these needs and provides other related advantages.

SUMMARY OF THE INVENTION

The present invention resides in a novelty shoe embodying a caricature of the head of an animal. The shoe comprises a sole and an upper which cooperate to form a foot-receiving compartment therebetween. The sole and the upper are configured such that a mouth of the caricature defines an entry for the foot-receiving compartment.

A first portion of the upper is attached to the sole and forms a lower jaw of the caricature. A second portion of the upper extends from the toe and forms an upper jaw of the caricature. The caricature may have representative teeth extending from the upper and lower jaws The upper second portion articulates relative to the entry of the footreceiving compartment between open and closed positions. A fastener releasably secures the upper second portion in the closed position. In the illustrated embodiments, the fastener comprises hook and loop tape fasteners disposed on facing surfaces of the upper first and second portions The hook and loop tape fasteners are positioned so as to be visibly concealed when the upper second portion is in the closed position. The teeth may have hook and loop tape positioned on the facing surfaces thereof in order to releasably secure the upper second portion in the closed position.

The upper first portion includes a slit capable of expansion to facilitate acceptance of a foot into the foot-receiving compartment. The upper first portion may include either a zipper or a fastening strap for closing the slit in order to securely hold the foot within the foot-receiving compartment. The strap may include double-sided hook and loop tape which fastens the strap as well as securing the upper second portion in the closed position.

The shoe may be displayed on a stand having a shoe support in the form of a headless animal. The shoe is positionable on the shoe support such that the addition of the shoe creates the appearance of a completed animal.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 6:
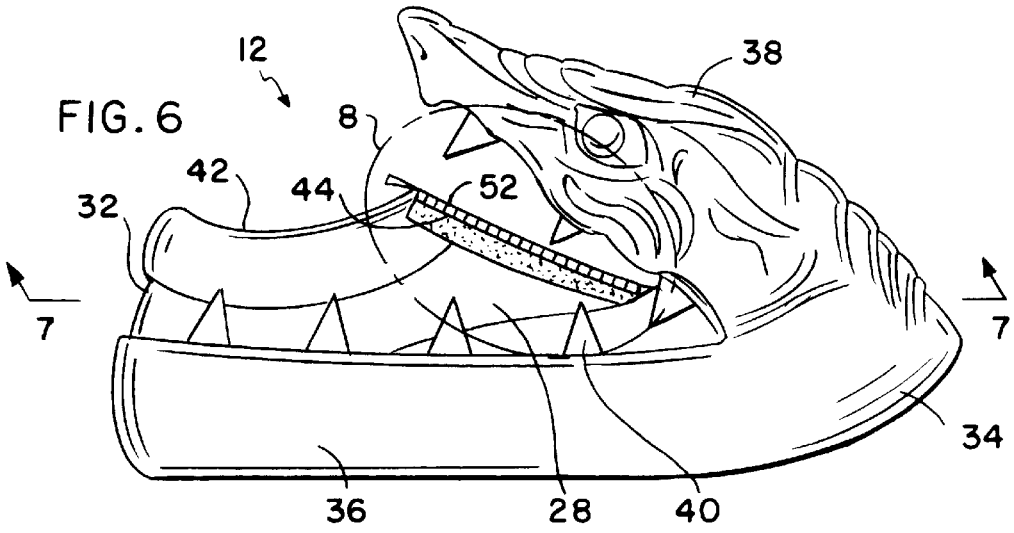
FIG. 6 is a side elevational view of a second type of novelty shoe embodying the invention.
Figure 7:
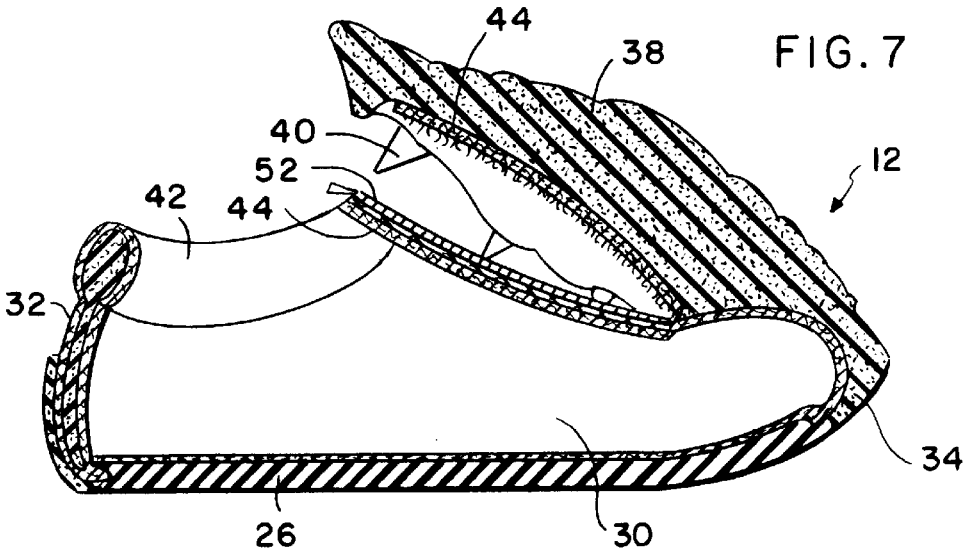
FIG. 7 is a cross-sectional view taken generally along line 7—7 of FIG. 6.
Figure 8:
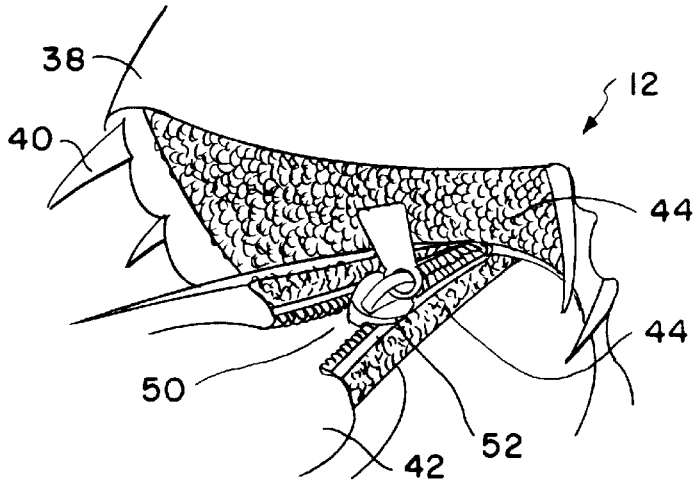
FIG. 8 is an enlarged fragmented perspective view of area 8 of FIG. 6.
Figure 9:
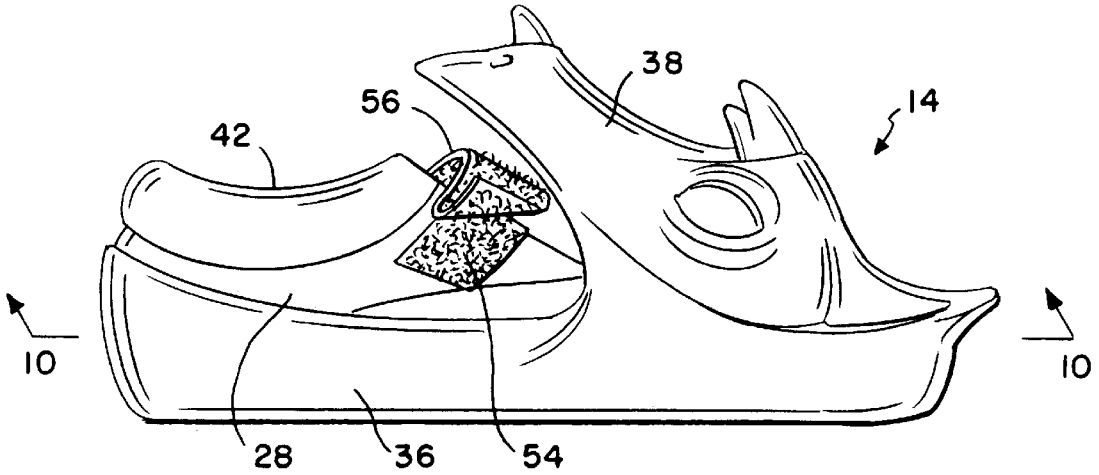
FIG. 9 is a side elevational view of a third type of novelty shoe embodying the present invention.
Figure 10:
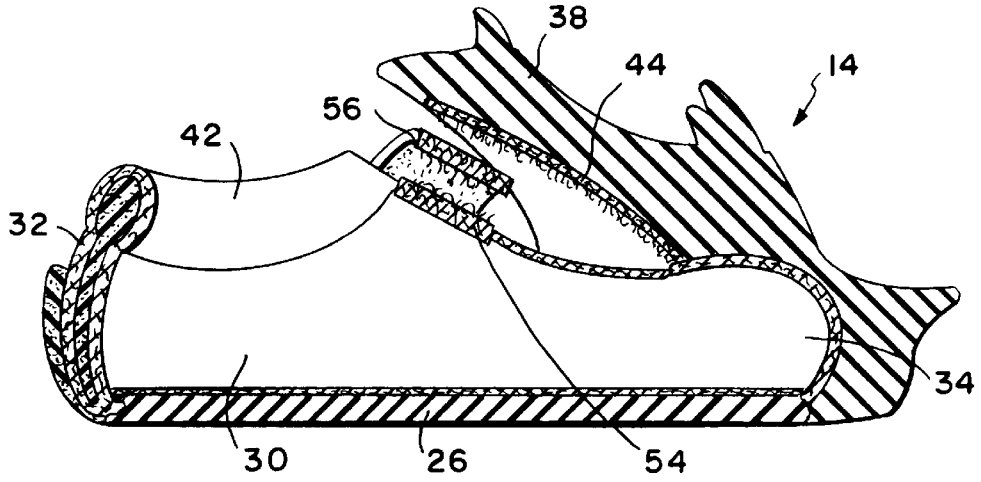
FIG. 10 is a cross-sectional view taken generally along line 10—10 of FIG. 9.
Figure 11:
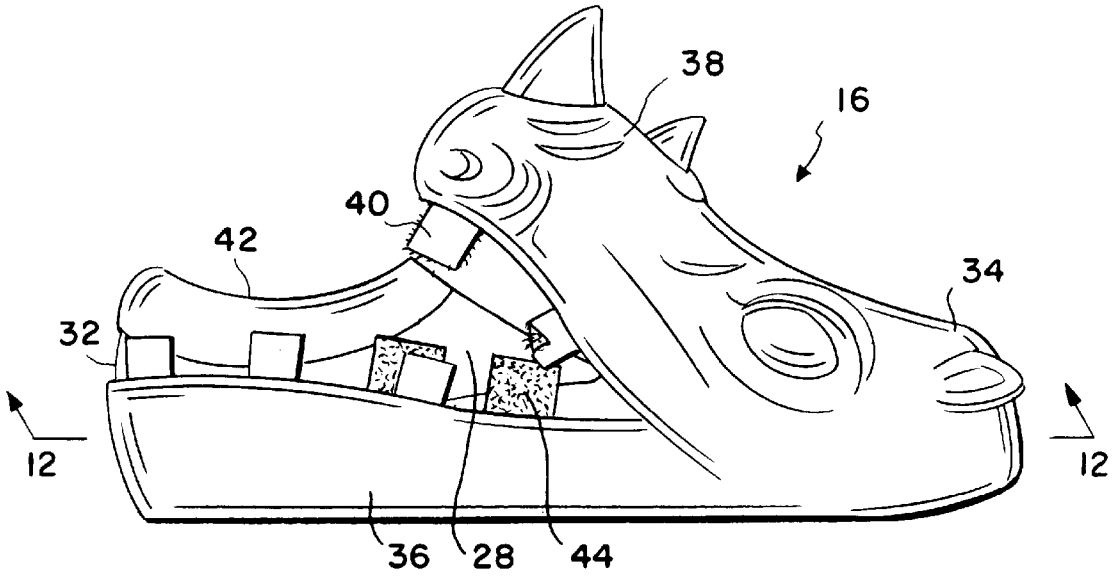
FIG. 11 is a side elevational view of a fourth type of novelty shoe embodying the present invention.
Figure 12:
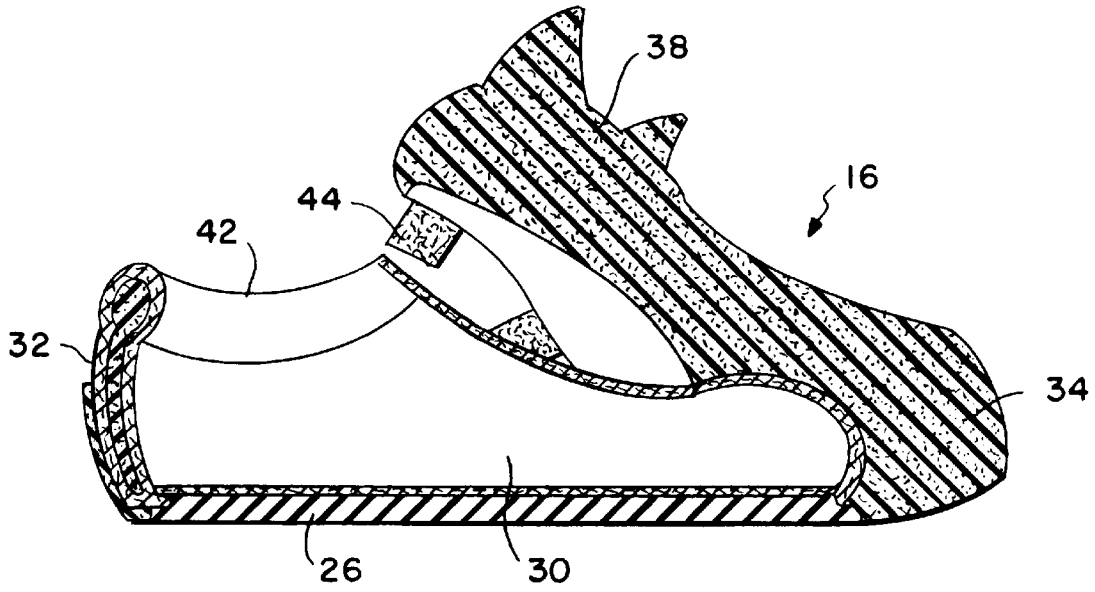
FIG. 12 is a cross-sectional view taken generally along line 12—12 of FIG. 11.

As shown in the drawings for purposes of illustration, the present invention is concerned with a novelty shoe embodying a caricature of the head of an animal, generally referred to in FIGS. 1–5 by the reference number 10, in FIGS. 6–8 by the reference number 12, in FIGS. 9–10 by the reference number 14, and in FIGS. 11–12 by the reference number 16.

In the following description, functionally equivalent components of the various embodiments are referred to by the same reference number.

Figure 1:
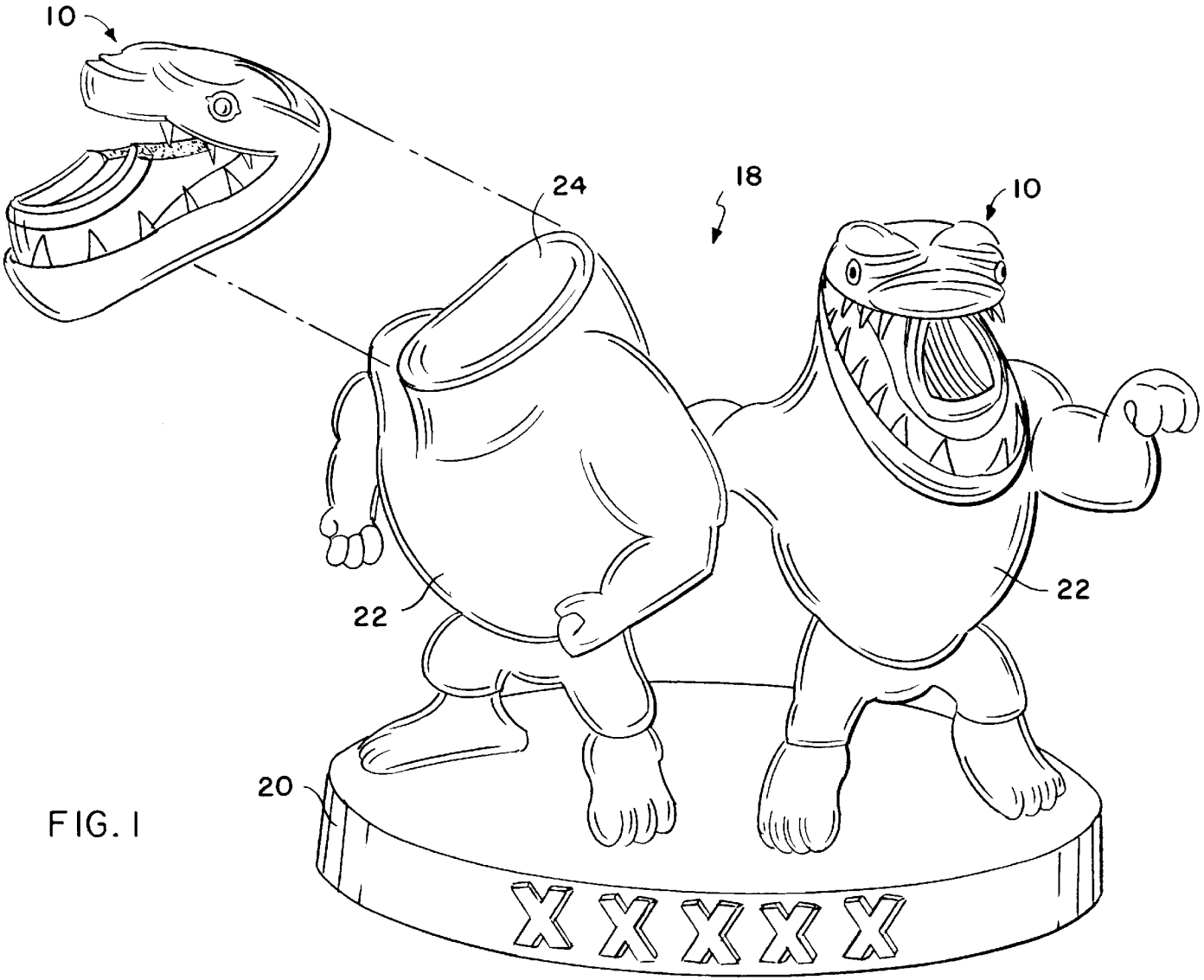
FIG. 1 is a partially exploded perspective view of a shoe display and novelty shoes embodying the present invention.

Referring to FIG. 1, the shoe 10 is displayable on a stand 18 having a platform 20 and shoe supports 22 in the form of headless animals extending upwardly from the platform 20. The supports 22 are configured such that a generally flat or only slightly angled plane 24 is created at the neck of the animal. Placement of the shoe 10 on the plane 24 of the support 22 gives the appearance of a completed animal as the shoe 10 is configured as a head of the animal. The shoes 10 remain on the supports 22 without the need for fasteners or other retaining devices. A shoe 10 can be lifted from the display stand 18 for examination and trial and then replaced back onto the plane 24 of the support 22.for redisplay. Placing the shoe 10 in differing positions on the support 22 creates the appearance that the animal is looking in differing directions. Shoes having different animal head designs can also be used to alter the overall appearance of the display stand 18.

Referring now to FIGS. 2–5, the shoe 10 is generally comprised of a sole 26 and an upper 28 which extends upwardly from the sole 26. The sole 26 and the upper 28 cooperate to form a foot-receiving compartment 30 within the shoe 10. The sole 26 and upper 28 can be constructed of a variety of durable yet flexible materials. In its intended preferred form, the shoe 10 is of an athletic or tennis style, allowing the wearer (typically a child) to walk, run and play in a variety of environments.

The upper 28 has a heel 32 towards the rear of the shoe 10 and a toe 34 towards the front of the shoe 10. The upper 28 includes a first portion 36 which is attached to the sole 26. At least a portion of the upper first portion 36 extends from the toe 34 towards the heel 32 to form a representative lower jaw of the caricature's head. Preferably, the first portion 36 fully wraps around the heel 32 of the shoe 10 to give the appearance that the shoe 10 is within the lower jaw of the animal.

Figure 2:
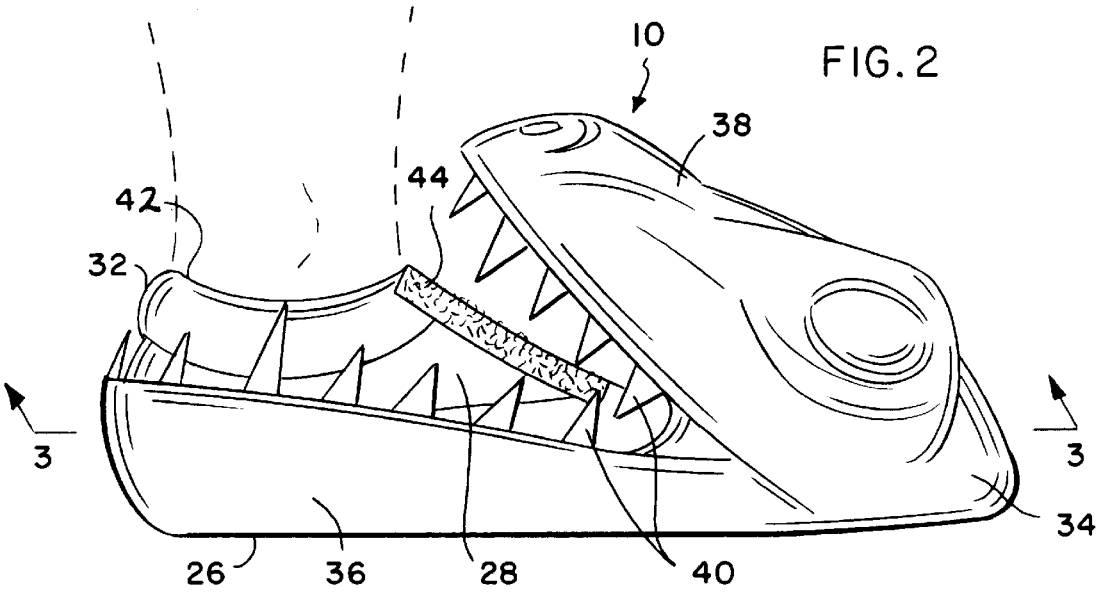
FIG. 2 is a side elevational view of the novelty shoe of FIG. 1, illustrated in an open configuration to permit foot insertion into or withdrawal from a foot-receiving compartment.
Figure 4:
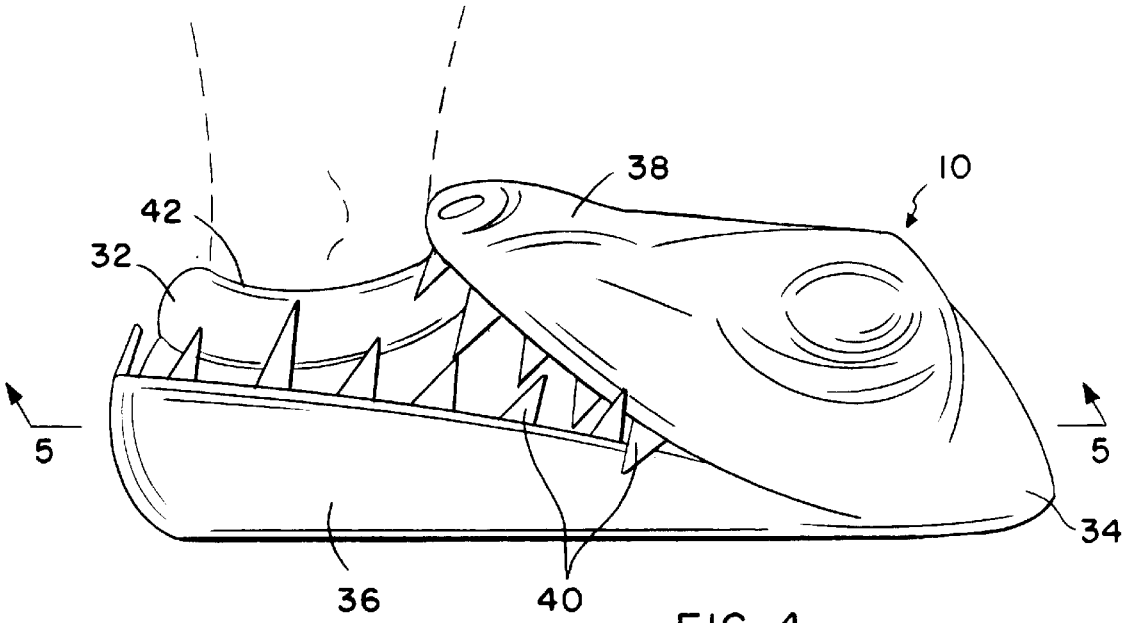
FIG. 4 is a side elevational view of the novelty shoe of FIGS. 1–3, illustrated in a "closed" configuration.
Figure 5:
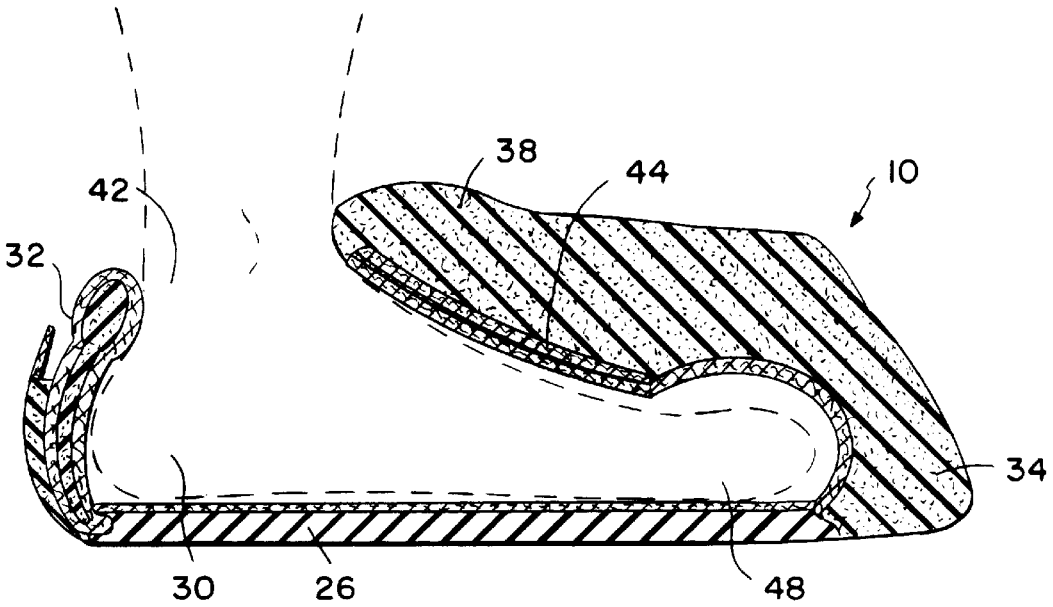
FIG. 5 is a cross-sectional view taken generally along line 5—5 of FIG. 4.

The upper 28 also includes a second portion 38 which extends from the toe 34, forming the head and upper jaw of the animal caricature. The shoe 10 can be constructed so that representative teeth 40 extend from the lower jaw first portion 36 and the upper jaw second portion 38 of the caricature's head. The upper second portion 38 articulates relative to an entry 42 of the foot-receiving compartment 30 so as to be in an open position, as illustrated in FIG. 2, or a closed position, as illustrated in FIG. 4. With the upper second portion 38 in the closed position, an appearance is created that the shoe, and thus the foot of the wearer, is within the closed mouth of the animal.

Fasteners, typically in the form of hook and loop tape fasteners 44, are disposed on facing surfaces of the upper first portion 36 and upper second portion 38. The fasteners 44 engage one another when the upper second portion 38 is pushed onto the upper first portion 36 to securely hold the upper second portion 38 in a closed position. The hook and loop tape fasteners 44 are positioned on the respective upper first and second surfaces 34 and 36 so as to be visibly concealed when the second portion 38 is in the closed position.

Figure 3:
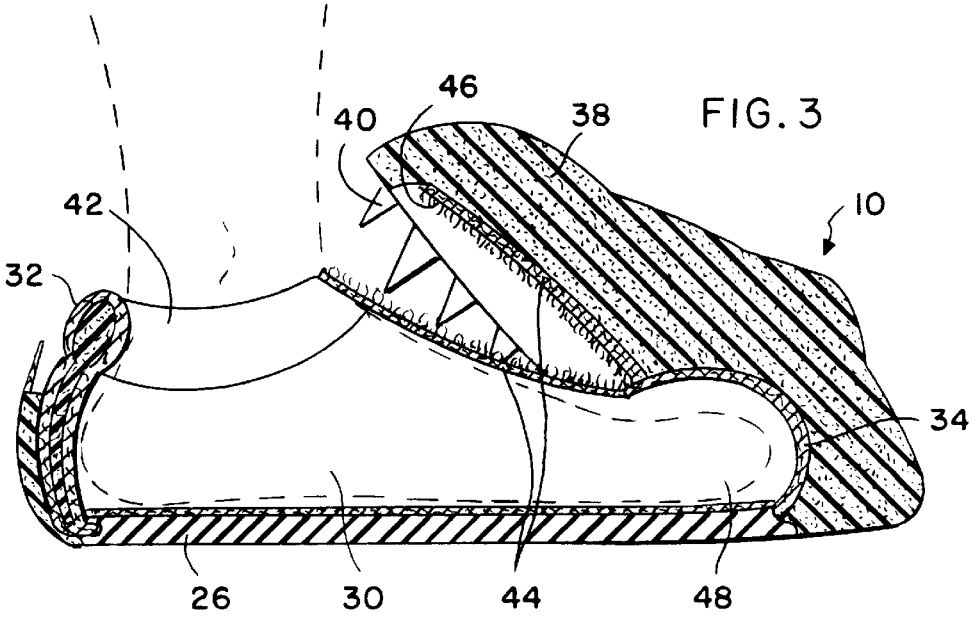
FIG. 3 is a cross-sectional view taken generally along line 3—3 of FIG. 2.

As illustrated in FIG. 3, the inner surface 46 of the upper second portion 38 can be lined with hook and loop tape 44. Complementary hook and loop tape 44 is placed on a facing surface of the upper first portion 36. Typically, the complementary hook and loop tape 44 is placed on an arch of the upper first portion 36 between the entry 42 to the foot-receiving compartment 30 and the toe 34 of the upper 28.

As shown in FIGS. 2–5, the shoe 10 can be constructed so that the entry 42 into the foot-receiving Compartment 30 is configured to easily accept a foot 48. The entry 42 can be enlarged and/or the upper first portion 36 can be constructed of a flexible, pliable material which can stretch or otherwise flex around the foot while it is forcefully inserted into the foot-receiving compartment 30 of the shoe 10. The material used is preferably resilient so that the foot 48 is securely held in place. After insertion of the foot 48 into the foot-receiving compartment 30, the upper second portion 38 is pushed onto the upper first portion 36 engaging the hook and loop tape fasteners 44 which secure the upper second portion 38 in the closed position.

Alternatively, and as shown in FIGS. 6–10, the upper first portion 36 may include a slit 50 extending from an entry 42 to the foot-receiving compartment 30 towards the toe 34. The slit 50 can be opened or otherwise expanded in order to facilitate the acceptance of the foot 48 into the compartment 30. Likewise, the slit 50 can be closed in order to securely hold the foot 48 within the compartment 30.

As illustrated in FIGS. 6–8, the upper first portion 36 may include a zipper 52 disposed along the length of the slit 50 for opening and closing the slit 50. In use, the slit 50 is opened by unfastening the zipper 52 and the foot 48 is inserted into the compartment 30 through the entry 42 of the shoe 12. The foot 48 is secured within the shoe 12 by fastening the zipper 52. The upper second portion 38 is pressed onto the upper first portion 36, engaging the hook and loop tape fasteners 44 which securely hold the upper second portion 38 in the closed position.

As illustrated in FIGS. 9 and 10, the upper first portion 36 may include straps 54 which can be released to open the slit 50, or fastened to close the slit 50. The fastening straps 54 are preferably comprised of double-sided hook and loop tape 56. Aside from fastening the straps 54 together, the upper exposed side of the double-sided hook and loop tape 56 is engageable with the hook and loop tape 44 on the facing inner surface 46 of the upper second portion 38. In use, the straps 54 are first released, opening the slit 50. The foot 48 is inserted into the compartment 30 through the entry 42 of the shoe 14. The straps 54 are pulled across one another and fastenably engaged to close the slit 50 and secure the foot 48 within the shoe 14. The upper second portion 38 is pressed downwardly onto the upper first portion 36, engaging the upper side of the double-sided hook and loop tape 56 of the straps 54 to the hook and loop tape 44 of the inner surface 46 of the upper second portion 38.

FIGS. 11 and 12 illustrate yet another method of fastening the upper first and second portions 34 and 36 together in a closed manner. Hook and loop tape 44 is positioned on the facing surfaces of preselected opposing teeth 40 of the first and second jaws of the upper first and second portions 34 and 36. In this fashion, after inserting the foot 48 into the shoe 16, the upper second portion 38 is pushed downwardly towards the upper first portion 36 and the teeth 40 having hook and loop tape 48 are overlaid and engaged with one another to secure the upper second portion 38 in a closed position. As the hook and loop tape 44 is concealed when the teeth 40 are overlaid, the natural appearance of the foot 48 being placed in an animal's closed mouth is retained.

From the foregoing, it will be appreciated that the novelty shoe 10–16 is designed and configured so that the shoes 10–16 can easily be placed on, worn, and taken off by a child. It will also be appreciated that the shoes 10–16 can be used comfortably in a variety of settings and environments. More so than other shoes of the past, the shoes 10–16 of the present invention are particularly entertaining and fascinating to children as nearly the entirety of the shoe 10–16 is configured as the mouth and head of an animal caricature, as opposed to decals and prints used on prior children's shoes. Furthermore, the shoes 10–16 are displayed in a manner which is easily viewable by the child and appealing to child and parent alike.

Although several embodiments have been described in detail for purposes of illustration, various modifications may be made to each without departing from the scope and spirit of the invention. Accordingly, the invention is not to be limited, except as by the appended claims.

What is claimed is:

1. A shoe, comprising:

a sole;

an upper including a heel and a toe, the upper cooperating with the sole to form a foot-receiving compartment therebetween;

wherein the sole and the upper cooperatively form a caricature of the head of an animal having a mouth which defines an entry for the foot-receiving compartment;

wherein the upper includes a first portion attached to the sole, at least a portion of which forms a lower jaw of the caricature, and a second portion extending from the toe which forms an upper jaw of the caricature;

wherein the upper second portion articulates relative to the entry of the foot-receiving compartment between an open position and a closed position; and a fastener for releasably securing the upper second portion in the closed position.

2. The shoe of claim 1, wherein the fastener comprises hook and loop tape fasteners disposed on facing surfaces of the upper first and second portions.

3. The shoe of claim 2, wherein the hook and loop tape fasteners are positioned so as to be visibly concealed when the upper second portion is in the closed position.

4. The shoe of claim 2, including representative teeth extending from the upper and lower jaws of the caricature, the teeth having hook and loop tape positioned on facing surfaces thereof.

5. The shoe of claim 1, wherein the upper first portion includes a slit capable of expansion to facilitate acceptance of a foot into the foot-receiving compartment, and closure in order to securely hold the foot within the foot-receiving compartment.

6. The shoe of claim 5, including a zipper for closing the slit.

7. The shoe of claim 5, including a fastening strap for closing the slit.

8. The shoe of claim 7, wherein the strap includes double-sided hook and loop tape.

9. The shoe of claim 1, including a shoe support in the form of a headless animal, the shoe being positionable on the shoe support such that the addition of the shoe creates the appearance of a completed animal.

10. A shoe, comprising:

sole;

an upper including a heel and a toe, the upper cooperating with the sole to form a foot-receiving compartment therebetween, wherein the upper forms a caricature of the head of an animal having a mouth which defines an entry for the foot-receiving compartment, the upper having a first portion attached to the sole, at least a portion of which forms a lower jaw of the caricature, and a second portion extending from the toe which forms an upper jaw of the caricature; and a fastener for releasably securing the upper second portion to the upper first portion.

11. The shoe of claim 10, wherein the upper second portion articulates relative to the entry of the foot-receiving compartment between an open position and a closed position.

12. The shoe of claim 11, including a fastener comprising hook and loop tape fasteners disposed on facing surfaces of the upper first and second portions for releasably securing the upper second portion in the closed position.

13. The shoe of claim 12, including representative teeth extending from the upper and lower jaws of the caricature, the teeth having hook and loop tape positioned on facing surfaces thereof, wherein the hook and loop tape fasteners are positioned so as to be visibly concealed when the upper second portion is in the closed position.

14. The shoe of claim 10, wherein the upper first portion includes a slit capable of expansion to facilitate acceptance of a foot into the foot-receiving compartment, and closure in order to securely hold the foot within the foot-receiving compartment.

15. The shoe of claim 14, including a zipper for closing the slit.

16. The shoe of claim 14, including a fastening strap having double-sided hook and loop tape for closing the slit.

17. The shoe of claim 10, including at least one shoe support in the form of a headless animal, the shoe being positionable on the shoe support such that the addition of the shoe creates the appearance of a completed animal.

18. A shoe, comprising:

a sole;

an upper including a heel and a toe, the upper cooperating with the sole to form a foot-receiving compartment therebetween, the sole and the upper cooperatively forming a caricature of the head of an animal having a mouth which defines an entry for the foot-receiving compartment, the upper having a first portion attached to the sole and including a slit capable of expansion to facilitate acceptance of a foot into the foot-receiving compartment, and closure in order to securely hold the foot within the foot-receiving compartment, at least a portion of the upper first portion forming a lower jaw of the caricature, the upper further having a second portion extending from the toe and articulatable relative to the entry of the foot-receiving compartment between an open and a closed position, the upper second portion forming an upper jaw of the caricature; and a fastener comprising hook and loop tape fasteners disposed on facing surfaces of the upper first and second portions for releasably securing the upper second portion to the upper first portion, the hook and loop tape fasteners positioned so as to be visibly concealed when the upper second portion is in the closed position.

19. The shoe of claim 18, including a zipper for closing the slit.

20. The shoe of claim 18, including a fastening strap having double-sided hook and loop tape for closing the slit.

21. The shoe of claim 18, including at least one shoe support in the form of a headless animal, the shoe being positionable on the shoe support such that the addition of the shoe creates the appearance of a completed animal.

22. A shoe, comprising:

a sole;

an upper including a heel and a toe, the upper cooperating with the sole to form a foot-receiving compartment therebetween, wherein the sole and the upper cooperatively form a caricature of the head of an animal having a mouth which defines an entry for the foot-receiving compartment; and a shoe support in the form of a headless animal, wherein the shoe is positionable on the shoe support such that the addition of the shoe creates the appearance of a completed animal.

23. The shoe of claim 22, wherein the upper includes a first portion attached to the sole, at least a portion of which forms a lower jaw of the caricature, and a second portion extending from the toe which forms an upper jaw of the caricature.

24. The shoe of claim 23, wherein the upper second portion articulates relative to the entry of the foot-receiving compartment between an open position and a closed position.

25. The shoe of claim 24, including a fastener for releasably securing the upper second portion in the closed position.

26. The shoe of claim 25, wherein the fastener comprises hook and loop tape fasteners disposed on facing surfaces of the upper first and second portions.

27. The shoe of claim 26, wherein the hook and loop tape fasteners are positioned so as to be visibly concealed when the upper second portion is in the closed position.

28. The shoe of claim 26, including representative teeth extending from the upper and lower jaws of the caricature, the teeth having hook and loop tape positioned on facing surfaces thereof.

29. The shoe of claim 25, wherein the upper first portion includes a slit capable of expansion to facilitate acceptance of a foot into the foot-receiving compartment, and closure in order to securely hold the foot within the foot-receiving compartment.

30. The shoe of claim 29, including a zipper for closing the slit.

31. The shoe of claim 29, including a fastening strap for closing the slit.

32. The shoe of claim 31, wherein the strap includes double-sided hook and loop tape.

* * * * *